US007402061B1

(12) United States Patent
Tseng

(10) Patent No.: US 7,402,061 B1
(45) Date of Patent: Jul. 22, 2008

(54) STRUCTURE OF ENERGY-EFFICIENT LAMP BASE

(76) Inventor: Ming-chi Tseng, No. 18, Jhensing E. St., Wufong Township, Taichung County 413 (TW)

( * ) Notice: Subject to any disclaimer, the term of this patent is extended or adjusted under 35 U.S.C. 154(b) by 0 days.

(21) Appl. No.: 11/987,288

(22) Filed: Nov. 29, 2007

Related U.S. Application Data

(63) Continuation-in-part of application No. 11/723,213, filed on Mar. 19, 2007, now abandoned.

(51) Int. Cl.
*H01R 33/08* (2006.01)
*H01R 33/02* (2006.01)

(52) U.S. Cl. ..... 439/236

(58) Field of Classification Search ..... 439/240, 439/241, 337, 236
See application file for complete search history.

(56) References Cited

U.S. PATENT DOCUMENTS 2,292,043 A * 8/1942 Bryant ..... 439/240

* cited by examiner

*Primary Examiner*—Javaid Nasri
(74) *Attorney, Agent, or Firm*—Rosenberg, Klein & Lee

(57) ABSTRACT

An improved structure of energy-efficient lamp base includes a fixing base, conductors, two elastic elements, and a bottom cover. The conductors are disposed and fixed in the fixing base by the elastic elements. The conductors go into the wire holes of the fixing base using back hooks, thereby fixing the wires. The bottom cover is inside the fixing base. A blocking part is used to block the wire inside the wire hole and the connecting pin of the energy-efficient lamp. The blocking part serves the purposes of double-blocking and preventing inappropriate contacts between the wires and the energy-efficient lamp. This improves the safety of the invention.

4 Claims, 3 Drawing Sheets

STRUCTURE OF ENERGY-EFFICIENT LAMP BASE

CROSS-REFERENCE TO RELATED APPLICATION

This application is a Continuation-In-Part Application of Ser. No. 11/723,213 filed on Mar. 19, 2007, and entitled "IMPROVED STRUCTURE OF ENERGY-EFFICIENT LAMP BASE" now abandoned

BACKGROUND OF THE INVENTION

1. Field of Invention

The invention relates to an improved structure of the energy-efficient lamp base and, in particular, to an energy-efficient lamp base that can be easily connected to a power outlet.

2. Related Art

A usual lamp base, as shown in FIG. 3, has a base 9, two springs 8, two conductive plates 7, and a cover 6. The inner side of the base 9 has two prong holes 91 for accommodating the connecting prongs of the energy-efficient lamp. The two conductive plates 7 are disposed inside the prong holes 91 of the base. They are fixed inside the base 9 under the push of the springs 8. Each of the two conductive plates 7 has a prong 71 connecting with a wire (not shown). The wire is clutched by two pinch plates 711 of the prong 71 of each conductive plate 7. The wire is then connected to the prong 71. Finally, a cover 6 covers the entire apparatus.

To obtain the above-mentioned conventional lamp base structure, each prong 71 holds one end of the wire before being disposed inside the base 9. In this case, the wire punching process of the prong 71 has to be finished first. Therefore, an appropriate length of the wire has to be determined before hand. Such a structure requires a complicated assembly procedure and cannot effectively control the wire length. It only increases the assembly cost and the stocking risk of the products.

FIELD OF INVENTION

The invention relates to a lamp base and, in particular, to an energy-efficient lamp base that can prevent the production of electrical current due to inappropriate contacts and can be easily connected with wires and the energy-efficient lamp.

SUMMARY OF THE INVENTION

A first objective of the invention is to solve the above-mentioned problems and to provide an improved structure of the energy-efficient lamp base. Two blocking parts separate wire holes and prong holes, serving the purposes of double-blocking and preventing inappropriate contacts between the wires and the energy-efficient lamp. This improves the safety of the invention.

A second objective of the invention is to provide elastic elements that keep two conductors away from each other. It makes full use of the space. The elastic elements are easy to mount.

A third objective of the invention is to provide a back hook inside the wire hole of the fixing base. This is convenient for the wire to be connected and fixed.

To achieve the above-mentioned objectives, the invention includes: a fixing base, two conductors, two elastic elements, and a bottom cover.

The fixing base forms an accommodating space, using two wire holes formed symmetrically on the top surface to communicate with the environment. The top surface of the accommodating space is formed with a fixing wall around each of the wire holes. The two fixing walls separate two hook slots and one accommodating slot.

Each of the conductors has a first fixing section and a second fixing section. Both ends of each fixing section are limited by the corresponding hook slots of the fixing base. A connecting section and an elastic section are extended respectively along the same side edge of the fixing section. The connecting section and the first fixing section are disposed on the same plane. The connecting section and the elastic section are perpendicular to each other. The connecting section is disposed in the corresponding wire hole of the fixing base. The end of the connecting section is bent into a back hook. The end of the back hook is further formed with a guide groove for fixing the wire. Each of the elastic sections is parallel to the top surface of the accommodating space. An elastic part is provided perpendicular to the elastic section via an extending part. The two elastic parts provide an elastic force toward the opening of the accommodating space of the fixing base to urge against the connecting pin of the energy-efficient lamp. A blocking part extends from between the fixing sections toward the elastic parts to block the connecting pin of the energy-efficient lamp.

The elastic elements are disposed in the accommodating slots. One end of each elastic element urges against the corresponding fixing wall of the fixing base. The other end urges against one fixing section of the conductors. The conductors are pushed away from each other.

The bottom cover covers the opening of the accommodating space of the fixing base. The covering surface of the bottom cover is formed with two symmetrically disposed prong holes. Each of the prong holes has an inserting section and a locking section. A connecting part extends from the circumference of each inserting section along the covering surface. Each of the connecting parts goes into the corresponding wire hole of the fixing base. The two connecting parts are connected respectively with a blocking part. The two block parts block the wire holes. Moreover, the two blocking parts and the wire holes are on the same line. Each of the two blocking parts is extended with a positioning post for urging against the corresponding connecting section of the conductor and fixing it.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
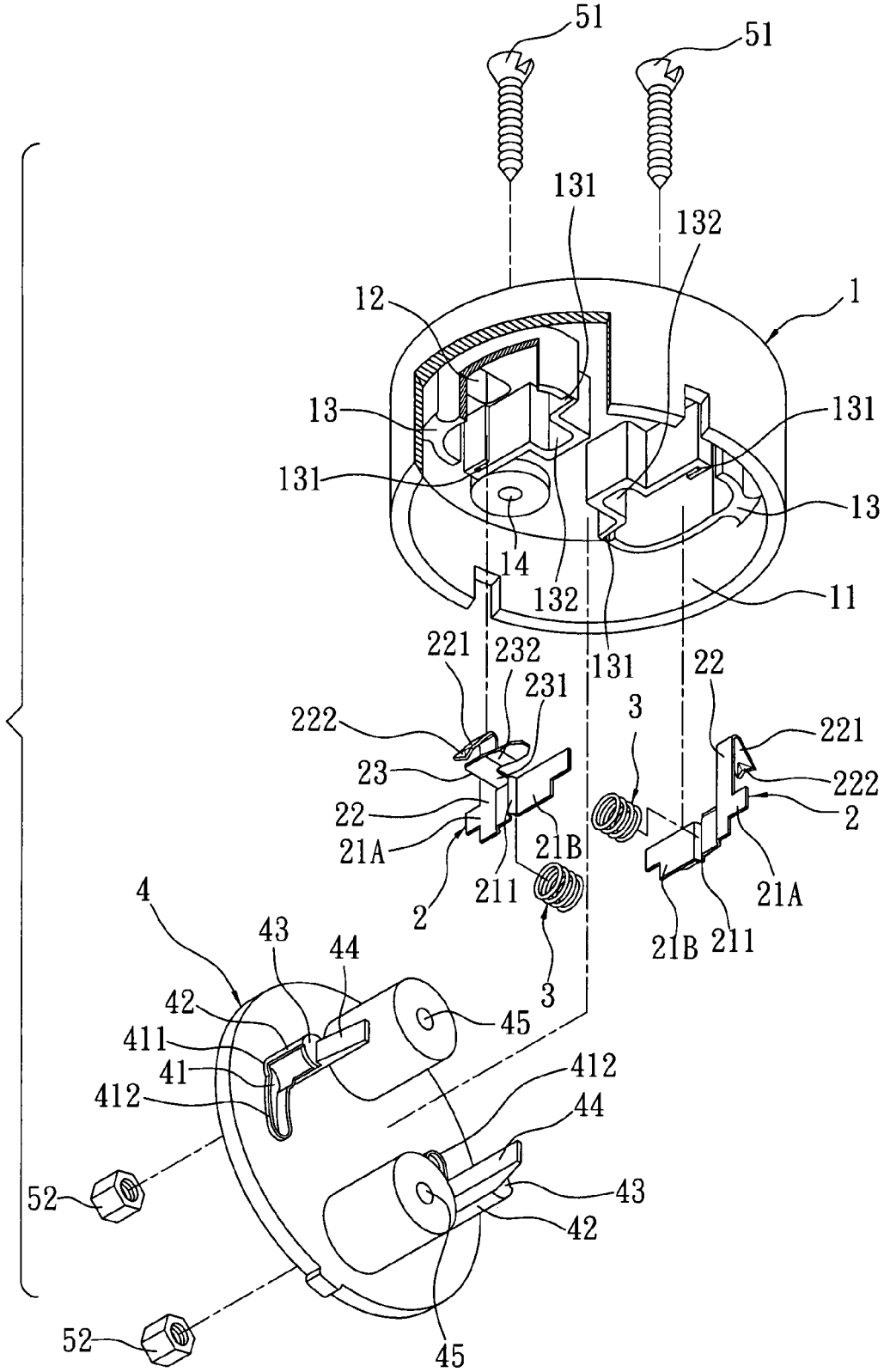
FIG. 1 is a three-dimensional exploded view of the invention.
Figure 2:
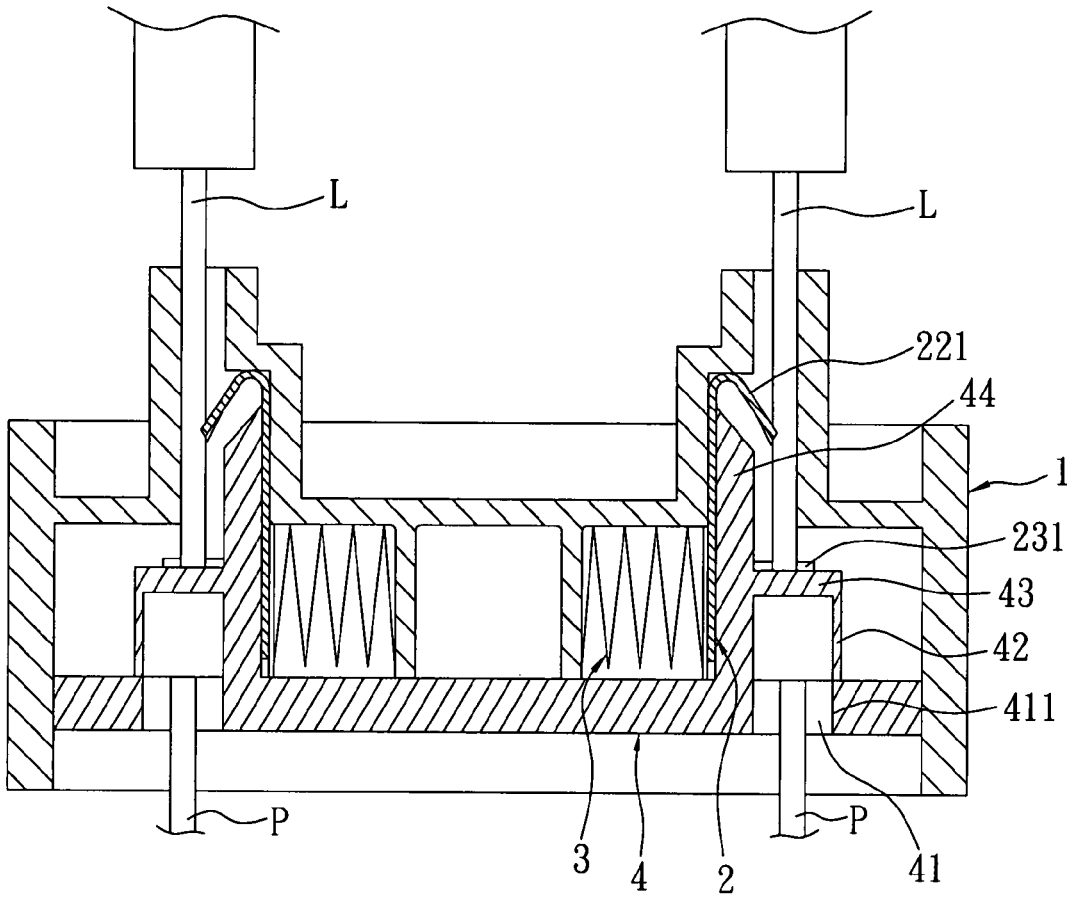
FIG. 2 is a cross-sectional view of the invention showing wires in the wire holes and installation of the energy-efficient lamp via the prong holes.
Figure 3:
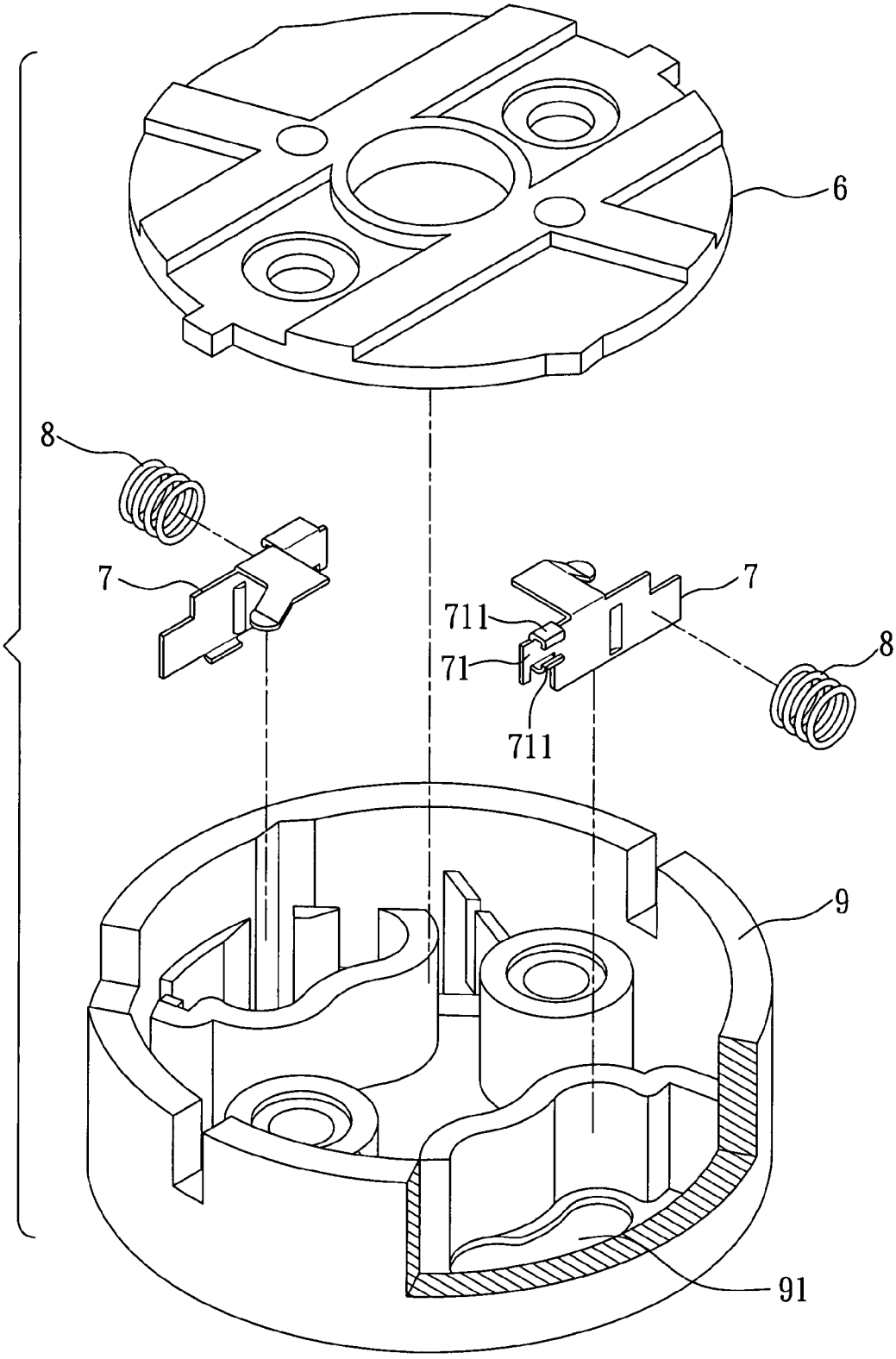
FIG. 3 PRIOR ART
FIG. 3 is a schematic view of a conventional lamp base.

A preferred embodiment of the invention is illustrated in FIG. 1 and FIG. 2. This embodiment provides an improved structure of energy-efficient lamp base for the insertion of the connecting pins of an energy-efficient lamp. The structure includes a fixing base 1, two conductors 2, two elastic elements 3, and a bottom cover 4.

The fixing base 1 has an accommodating space 11, using two wire holes 12 formed symmetrically on the top surface to communicate with the environment. The top surface of the accommodating space 11 is formed with a fixing wall 13 around each of the wire holes 12. The two fixing walls 13 separate two hook slots 131 and one accommodating slot 132. Besides, the top surface of the accommodating space 11 of the fixing base 1 is provided with at least one locking part 14. This embodiment uses two locking parts as an example, and the locking part is represented by a through hole.

Each of the conductors 2 has a first fixing section 21A and a second fixing section 21B. Both ends of each fixing section 21A, 21B are limited by the corresponding hook slots 131 of the fixing base 1. A connecting section 22 and an elastic section 23 are extended respectively along the same side edge of the fixing section 21A, 21B. The connecting section 22 and the first fixing section 21A are disposed on the same plane. The connecting section 22 and the elastic section 23 are perpendicular to each other. The connecting section 22 is disposed in the corresponding wire hole 12 of the fixing base 1. The end of the connecting section 22 is bent into a back hook 221. The end of the back hook 221 is further formed with a guide groove 222 for fixing the wire L. Each of the elastic sections 23 is parallel to the top surface of the accommodating space 11. An elastic part 232 is provided perpendicular to the elastic section 23 via an extending part 231. The two elastic parts 232 provide an elastic force toward the opening of the accommodating space 11 of the fixing base 1 to urge against the connecting pin P of the energy-efficient lamp. A blocking part 211 extends from between the fixing sections 21A, 21B toward the elastic parts 232 to block the connecting pin P of the energy-efficient lamp.

The elastic elements 3 are disposed in the accommodating slots 132. One end of each elastic element 3 urges against the corresponding fixing wall 13 of the fixing base 1. The other end urges against the second fixing section 21B of the conductors 2. The conductors 2 are thus pushed away from each other.

The bottom cover 4 covers the opening of the accommodating space 11 of the fixing base 1. The covering surface of the bottom cover 4 is formed with two symmetrically disposed prong holes 41. Each of the prong holes 41 has an inserting section 411 and a locking section 412. A connecting part 42 extends from the circumference of each inserting section 411 along the covering surface. Each of the connecting parts 42 goes into the corresponding wire hole 12 of the fixing base 1. The two connecting parts 42 are connected respectively with a blocking part 43. The two block parts 43 block the wire holes 12. Moreover, the two blocking parts 43 and the wire holes 12 are on the same line. Each of the two blocking parts 43 is extended with a positioning post 44 for urging against the corresponding connecting section 22 of the conductor 2 and fixing it. Besides, the bottom cover 4 is provided with at least one locking part 45. This embodiment uses through holes as the locking parts 45 as an example. The two locking parts 45 are provided corresponding to the locking parts 14 of the fixing base 1.

In this embodiment, the two locking elements are two bolts 51 and nuts 52. Each bolt 51 goes from the locking part 14 of the fixing base 1 through the locking part 45 of the bottom cover 4 to connect with the nut 52. This combines the fixing base 1 with the bottom cover 4.

As shown in FIG. 2, when the wire hole 12 is inserted with a wire L, the wire L is guided by the guide groove 222 of the connecting section 22 into the wire hole 12. The end of the wire L urges against the blocking part 43 of the bottom cover 4. At the same time, the back hook 221 hooks the inner wall of the wire hole to prevent the wire L from getting loose.

When the connecting pin P of the energy-efficient lamp is inserted, the connecting pin P is inserted via the inserting section 411 of the prong hole 41. The pin is first blocked by the blocking part 43 of the bottom cover 4. Afterwards, the connecting pin P is rotated to the locking section 412, so that the connecting pin P is blocked and fixed by the back hook 221 of the conductor 2. The elastic part 232 urges against the connecting pin P for the conductor 2 to supply electrical power.

As the energy-efficient lamp is installed, the connecting pin thereof is blocked by the corresponding blocking part, preventing inappropriate contacts between the wires and the connecting pin of the energy-efficient lamp. This can prevent the production of an instantaneous current when an energy-efficient lamp is inserted. Therefore, the invention is safer. Moreover, the elastic elements are provided to separate the two conductors. It makes full use of the space. The elastic elements are easy to mount.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An improved structure of energy-efficient lamp base for insertion of a connecting pin of an energy-efficient lamp, comprising:

a fixing base, which has an accommodating space in communication with two symmetrically formed wire holes on its top surface; wherein the top surface is formed with a fixing wall around each of the wire holes and the two fixing walls separate two hook slots and one accommodating slot;

two conductors, each of which has a first fixing section and a second fixing section, both ends of each fixing section being limited by the corresponding hook slots of the fixing base; wherein a connecting section and an elastic section are disposed adjacent a side edge of the first fixing section, the connecting section and the first fixing section are disposed on the same plane, the connecting section and the elastic section are perpendicular to each other, the connecting section is disposed in the corresponding wire hole of the fixing base, the end of the connecting section is bent into a back hook, the end of the back hook is further formed with a guide groove for fixing the wire, each of the elastic sections is parallel to the top surface of the accommodating space, an elastic part is provided perpendicular to each elastic section via an extending part, the two elastic parts provide an elastic force toward an opening of the accommodating space of a fixing base to urge against a connecting pin of the energy-efficient lamp, and a blocking part extends from between the fixing sections toward the elastic parts to block the connecting pin of the energy-efficient lamp;

two elastic elements, each of which is disposed in the corresponding accommodating slot; wherein one end of each of the elastic elements urges against the corresponding accommodating slot of the fixing base, the other end urges against one fixing section of the conductor, and the conductors are pushed away from each other;

a bottom cover, which covers the opening of the accommodating space of the fixing base; wherein two prong holes are formed symmetrically on the covering surface of the bottom cover, each of the prong holes has an inserting section and a locking section, a connecting part extends from a circumference of each inserting section along the covering surface, each of the connecting parts goes into the corresponding wire hole of the fixing base, the two connecting parts are connected respectively with a blocking part, the two blocking parts block the wire holes, the two blocking parts and the wire holes are on the same line, and each of the two blocking parts is extended with a positioning post for urging against the corresponding connecting section of the conductor and fixing it.

2. The improved structure of energy-efficient lamp base as in claim 1, wherein the two elastic elements urge against the second fixing sections of the conductors, respectively, to push them away from each other.

3. The improved structure of energy-efficient lamp base as in claim 1, wherein the top surface of the accommodating space is provided with at least one locking part and the bottom cover is also provided with at least one locking part, the two locking parts correspond to each other so as to connect the fixing base and the bottom cover.

4. The improved structure of energy-efficient lamp base as in claim 3, wherein the locking parts of the fixing base are two through holes and the lock parts of the bottom cover are also two through holes, and two locking elements go through them to connect the fixing base and the bottom cover.

* * * * *